US011378100B2

(12) United States Patent
Hu

(10) Patent No.: US 11,378,100 B2
(45) Date of Patent: Jul. 5, 2022

(54) OSCILLATING PORTABLE FAN WITH REMOVABLE GRILLE

(71) Applicant: E. MISHAN & SONS, INC., New York, NY (US)

(72) Inventor: Bingo Hu, Zhejiang (CN)

(73) Assignee: E. Mishan & Sons, Inc., New York, NY (US)

( * ) Notice: Subject to any disclaimer, the term of this patent is extended or adjusted under 35 U.S.C. 154(b) by 59 days.

(21) Appl. No.: 17/107,855

(22) Filed: Nov. 30, 2020

(65) Prior Publication Data

US 2021/0079931 A1 Mar. 18, 2021

(51) Int. Cl.
*F04D 29/70* (2006.01)
*F04D 27/00* (2006.01)
(Continued)

(52) U.S. Cl.
CPC ..... *F04D 29/703* (2013.01); *F04D 25/0673* (2013.01); *F04D 27/00* (2013.01); *F04D 29/522* (2013.01)

(58) Field of Classification Search
CPC ..... F04D 25/0673; F04D 25/08; F04D 27/00; F04D 29/522; F04D 29/703
See application file for complete search history.

(56) References Cited

U.S. PATENT DOCUMENTS 1,248,284 A 11/1917 Dickenson
1,767,060 A 6/1930 Ferguson
(Continued)

FOREIGN PATENT DOCUMENTS

CN 201830426596.0 12/2018
CN 201930042728.4 7/2019
EA 004678647-0001 4/2018

OTHER PUBLICATIONS https://www.amazon.com/dp/B07VCJMC9Z/ref=cm_sw_r_cp_apa_i_luTIDbF3WCBVD.
(Continued)

*Primary Examiner* — Patrick Hamo
(74) *Attorney, Agent, or Firm* — Notaro, Michalos & Zaccaria P.C.

(57) ABSTRACT

A rechargeable electric fan with a fan portion, a base portion, and a telescoping mast hingedly attached to and connecting the fan portion and the base portion. The fan portion has removable front grille, engageable in a first position in which the grille is retained in the front opening of the housing of the fan portion. The grille is rotatable from the first position to a second position in which the grille is released from the front opening. Slots are disposed on a periphery of the grille, and are configured to engage with corresponding tabs disposed on a periphery of the front opening, to retain the grille in the first position, and to release the grille when it is rotated into the second position. To prevent inadvertent release of the grille, a latch mechanism is configured and disposed to lock the grille in the first position, the latch mechanism comprising a button and a latch configured and disposed to release the lock when the button is depressed. The base portion comprises an oscillating mechanism including of a motor-driven pinion which engages an annular gear in the floor of the base portion. The floor is rotatably retained to the remainder of the base portion, so that when the pinion is turned by the motor, the entire fan turns about the stationary floor.

7 Claims, 12 Drawing Sheets

(51) Int. Cl.
*F04D 29/52* (2006.01)
*F04D 25/06* (2006.01)

(56) References Cited

U.S. PATENT DOCUMENTS 2,100,923 A 11/1937 Schmidt et al.
2,510,132 A 6/1950 Morrison
2,746,673 A 5/1956 Collins
2,808,198 A 10/1957 Morrison
2,813,673 A 11/1957 Smith
4,337,088 A 6/1982 Moses, Jr.
D291,352 S 8/1987 Kouno et al.
4,703,152 A 10/1987 Shih-Chin
4,732,539 A 3/1988 Shin-Chin
D307,470 S 4/1990 Utsuki et al.
4,927,120 A 5/1990 Wang
4,927,324 A * 5/1990 Coup ..... F04D 29/703 415/181
5,281,103 A 1/1994 Lin
5,310,313 A 5/1994 Chen
5,411,373 A 5/1995 Chiu et al.
5,468,124 A 11/1995 Chen
5,518,370 A 5/1996 Wang et al.
5,695,271 A 12/1997 Zeller
D424,681 S * 5/2000 Lozzio ..... D23/382
6,079,949 A * 6/2000 Litvin ..... F04D 29/601 416/246
6,139,270 A 10/2000 Liao
6,206,530 B1 3/2001 Eberts
D442,371 S 5/2001 Eberts
6,454,539 B1 9/2002 Santos
D470,665 S 2/2003 Harris et al.
6,932,579 B2 8/2005 Cichetti, Sr. et al.
D510,994 S 10/2005 Indio Da Costa
6,953,322 B2 10/2005 Lim
7,017,871 B2 3/2006 Chen
D520,132 S 5/2006 Jones
7,059,826 B2 6/2006 Lasko
D524,469 S 7/2006 Pitot et al.
7,244,179 B2 7/2007 Chien
D549,968 S 9/2007 Pitot et al.
7,316,540 B2 1/2008 Russak et al.
7,540,474 B1 6/2009 Huang et al.
7,664,377 B2 2/2010 Liao
7,775,848 B1 8/2010 Auerbach
7,806,388 B2 10/2010 Junkel et al.
8,092,166 B2 1/2012 Nicolas et al.
D674,476 S 1/2013 Junkel
D674,746 S 1/2013 Junkel et al.
D684,249 S 6/2013 Herbst
8,721,286 B2 * 5/2014 Gammack ..... F04D 29/681 416/246
8,734,109 B2 * 5/2014 He ..... F04D 25/084 416/246
8,894,377 B2 11/2014 Greenberg
D721,431 S 1/2015 Herbst
D727,488 S 4/2015 Hsu
9,121,410 B2 9/2015 Yu
9,677,703 B2 6/2017 He et al.
D801,060 S 10/2017 Hollinger
D824,012 S 7/2018 Xu
10,016,045 B1 7/2018 Hollinger
D825,048 S 8/2018 Breit et al.
D827,121 S * 8/2018 Wang ..... D23/378
D837,963 S 1/2019 Xu
10,184,479 B2 1/2019 Xu
D855,171 S 7/2019 Xu
D881,371 S * 4/2020 Hollinger ..... D23/382
D884,146 S 5/2020 Hollinger
2003/0059307 A1 * 3/2003 Moreno ..... F04D 29/646 416/246
2003/0231958 A1 12/2003 Murray, Jr. et al.
2005/0031448 A1 2/2005 Lasko et al.
2005/0053465 A1 3/2005 Roach et al.
2005/0128698 A1 6/2005 Huang
2005/0204578 A1 9/2005 Taylor
2006/0172682 A1 8/2006 Orr et al.
2006/0199515 A1 9/2006 Lasko et al.
2007/0065280 A1 3/2007 Fok
2007/0166160 A1 7/2007 Russak et al.
2008/0069694 A1 3/2008 Hernandez et al.
2009/0026850 A1 1/2009 Fu
2010/0226749 A1 9/2010 Gammack et al.
2010/0226750 A1 9/2010 Gammack
2010/0226752 A1 9/2010 Gammack et al.
2010/0226753 A1 9/2010 Dyson et al.
2010/0226754 A1 9/2010 Hutton et al.
2010/0226758 A1 9/2010 Cookson et al.
2010/0226763 A1 9/2010 Gammack et al.
2010/0226764 A1 9/2010 Gammack et al.
2010/0226769 A1 9/2010 Helps
2010/0226771 A1 9/2010 Crawford et al.
2010/0226787 A1 9/2010 Gammack et al.
2010/0226797 A1 9/2010 Fitton et al.
2010/0226801 A1 9/2010 Gammack
2010/0254800 A1 10/2010 Fitton et al.
2011/0164959 A1 7/2011 Fitton et al.
2011/0223014 A1 9/2011 Crawford et al.
2011/0223015 A1 9/2011 Gammack et al.
2012/0031509 A1 2/2012 Wallace et al.
2012/0033952 A1 2/2012 Wallace et al.
2012/0034108 A1 2/2012 Wallace et al.
2012/0039705 A1 2/2012 Gammack
2012/0045315 A1 2/2012 Gammack
2012/0045316 A1 2/2012 Gammack
2012/0057959 A1 3/2012 Hodgson et al.
2012/0093629 A1 4/2012 Fitton et al.
2012/0093630 A1 4/2012 Fitton et al.
2012/0230658 A1 9/2012 Fitton et al.
2013/0011252 A1 1/2013 Crawford et al.
2013/0026333 A1 1/2013 Wu
2013/0287548 A1 10/2013 Dyson et al.
2013/0294905 A1 11/2013 Gammack et al.
2014/0227085 A1 8/2014 Yu
2018/0142845 A1 5/2018 Lee
2019/0055951 A1 2/2019 Jacobs
2019/0101127 A1 4/2019 Xing et al.
2019/0162196 A1 5/2019 Ahuja

OTHER PUBLICATIONS

My Foldaway Fan Official Website (retrieved Nov. 16, 2020).
Web page at http://info.homea.hc360.com/2013/06/141714951798.shtml (retrieved Sep. 8, 2020).
Web page at https://www.epochtimes.com/GB/15/12/14/n4595389.htm (retrieved Sep. 8, 2020).
Web page at https://prtimes.jp/main/html/rd/p/000002047.000011495.html (retrieved Sep. 10, 2020).
Sanwa Supply 400-TOY045W (2020).
Teknos catalog (2020).
Teknos SI-001U SI-002UG (2020).

* cited by examiner

OSCILLATING PORTABLE FAN WITH REMOVABLE GRILLE

FIELD AND BACKGROUND OF THE SUBJECT TECHNOLOGY

The subject technology relates to portable electric fans for ventilation, placeable on a tabletop or floor surface, for example.

SUMMARY OF THE SUBJECT TECHNOLOGY

According to an aspect of the subject technology, an electric fan comprises a fan portion, a base portion, and a telescoping mast having a first end and a second end, the mast hingedly attached to the fan portion at the first end and hingedly attached to the base portion at the second end. The fan portion comprises a fan housing having a front opening, an electric fan motor disposed within the fan housing, fan blades attached to a spindle of the fan motor; and a removable grille disposed in the front opening of the fan housing. The grille and front opening are configured and disposed to be engageable in a first position in which the grille is retained in the front opening and is manually rotatable from the first position to a second position in which the grille is released from the front opening. In an embodiment, slots are disposed on a periphery of the grille, and are configured to engage with corresponding tabs disposed on a periphery of the front opening, to retain the grille in the first position, and to release the grille when it is rotated into the second position.

To prevent inadvertent release of the grille from the fan portion, a latch mechanism is provided, which is configured and disposed to lock the grille in the first position until the latch is manually actuated to release. In an embodiment the latch mechanism comprises a button and a latch configured and disposed to release the lock when the button is depressed, permitting manual rotation to the second (released) position. The electric fan further comprises a rechargeable battery power source for the electric fan motor, and at least one user-operable button and electronic circuitry for controlling and selectively powering the electric fan motor from the battery power source.

According to a further aspect of the subject technology, the base portion of the electric fan comprises a base housing and a base floor having feet disposed to contact an underlying surface, the floor being rotatably retained to the remainder of the base portion. In an embodiment, the floor is rotatably retained by a flanged hub attached to the remainder of the base portion.

According to a further aspect of the subject technology the base portion further comprises an oscillating mechanism disposed within the base housing, the oscillating mechanism comprising an electric base motor, the electric fan further comprising at least one user-operable button and electronic circuitry for controlling and selectively powering the electric base motor from the battery power source. In an embodiment, the oscillating mechanism further comprises a pinion disposed on a spindle of the electric fan motor and the floor comprises an annular gear, the pinion engaged with the annular gear, such that when the electric base motor is powered to turn the pinion, the remainder of the base portion, and the mast, and the fan portion, are turned with respect to the floor. Advantageously, the floor is rotatably retained to the remainder of the base portion by a flanged hub attached to the remainder of the base portion.

DETAILED DESCRIPTION OF THE SUBJECT TECHNOLOGY

Figure 1:
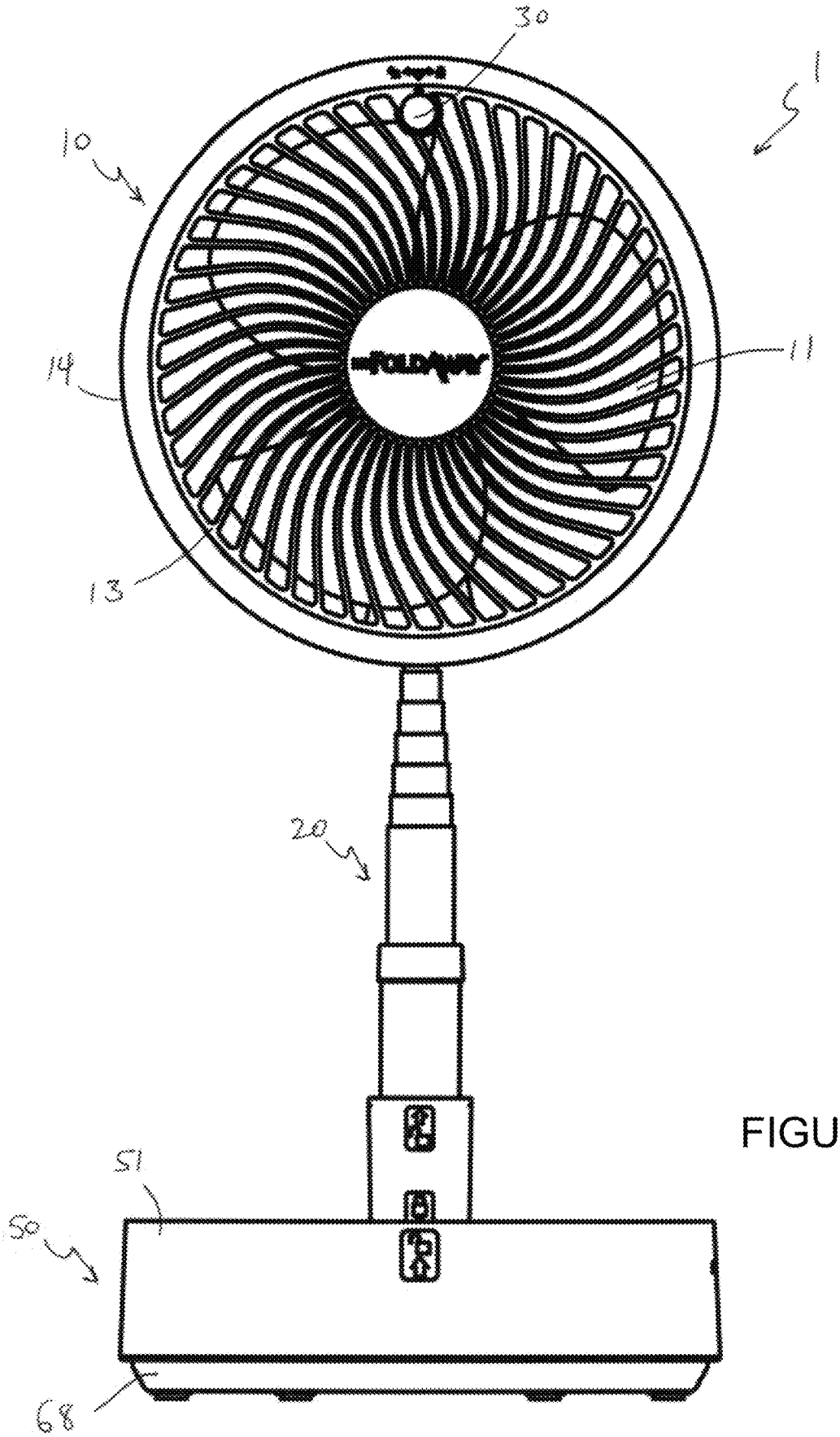
FIG. 1 is a front elevation view of an electric fan according to an embodiment.
Figure 2:
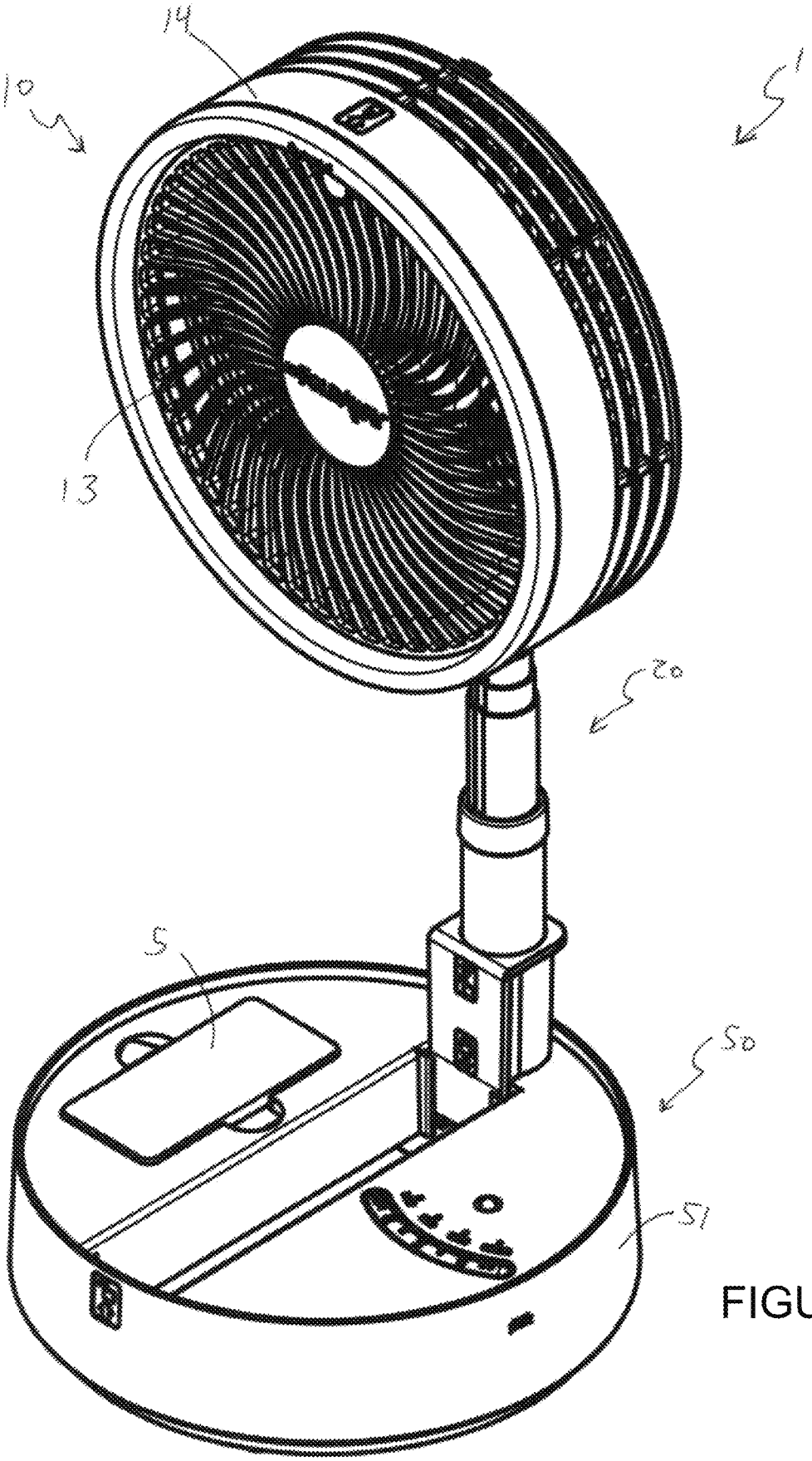
FIG. 2 is a front perspective view of an electric fan according to an embodiment.

According to non-limiting aspects of the subject technology, FIGS. 1-15 show an embodiment of an electric fan 1 which is foldable to a compact configuration; which can be selectively powered to oscillate to distribute fan motive power in different directions; which is rechargeable; and which can operate by a remote-control transmitter.

According to an aspect of the subject technology, electric fan 1 comprises fan portion 10 and base portion 50. Fan portion 10 is disposed at the end of telescoping mast 20, which is hingedly attached to fan portion 10 at one end and base portion 50 at the other end. Mast 20 comprises nested tubes which are configured and disposed to expand and contract telescopically by manual operation by the user, so that fan portion 20 can be supported on base portion 50 at a height desired by the user. Due to the hinged connection of mast 20 to fan portion 10 and base portion 50, fan 1 is collapsible by contracting mast 20 to its shortest configuration and folding fan portion 10 to be disposed on base portion 50.

According to another aspect of the subject technology, as best seen in FIGS. 3-9, fan portion 10 comprises fan housing 14 which houses an electric fan motor 12, fan blades 11 driven by the fan motor 12 when the motor is actuated, and removable front grille 13 disposed in a front-facing opening of fan housing 14. Grille 13 has slots 15 on the periphery thereof which interlock with mating tabs in the periphery of the front opening of fan housing 14, by which engagement, grille 13 is held in place in the front-facing opening of fan housing 14. Alternatively, tabs are disposed on the periphery of grille 13 and corresponding slots are disposed on the periphery of the front opening of fan housing 14. In either case, the tabs and slots are configured so that by rotating the grille 13 slightly to a non-interlocked release position, for example by about 5 degrees, the engagement is released and grille 13 may be manually removed from fan housing 14.

Figure 3:
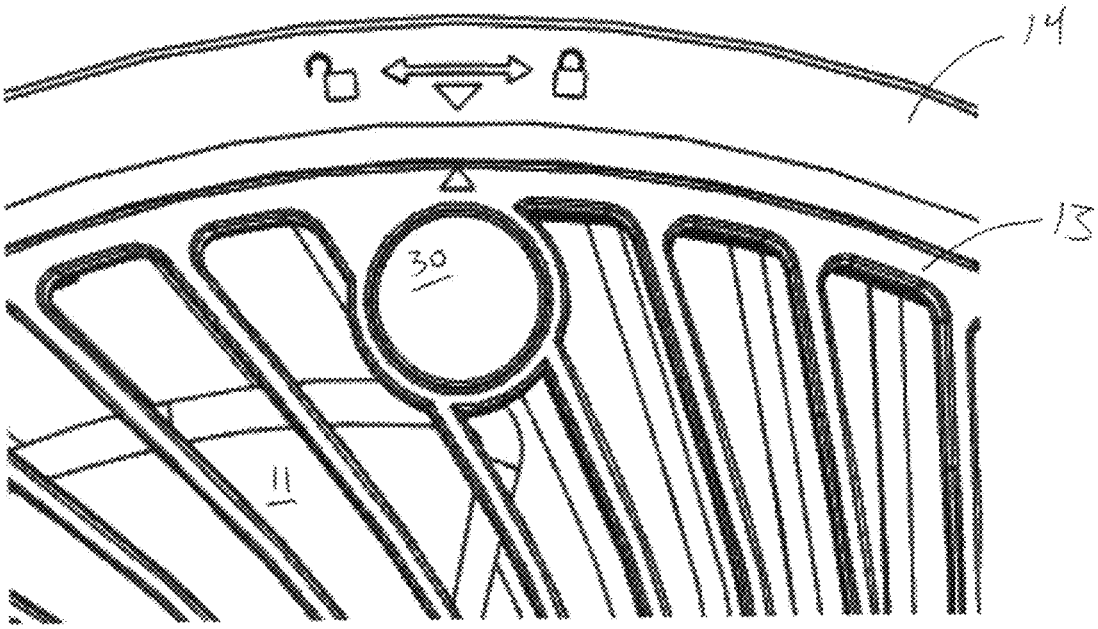
FIG. 3 is front detail view of the fan portion having a removable grille and latch button according to an embodiment.
Figure 4:
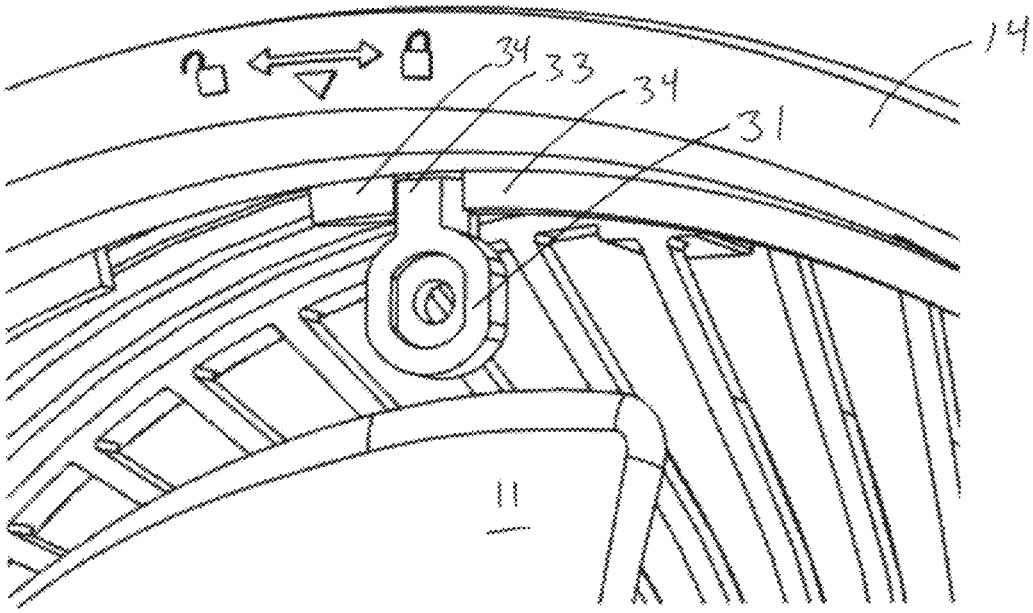
FIG. 4 is a detail view of the fan portion with the grille removed, showing the disposition of a latch in a gap between two tabs.
Figure 5:
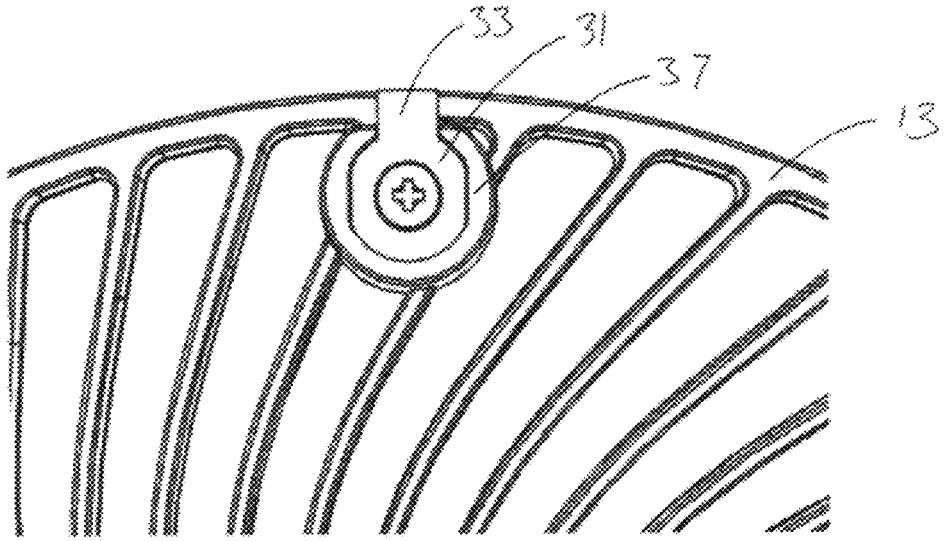
FIG. 5 is a detail view of the rear face of the removable grille, showing the disposition of the latch mechanism.
Figure 6:
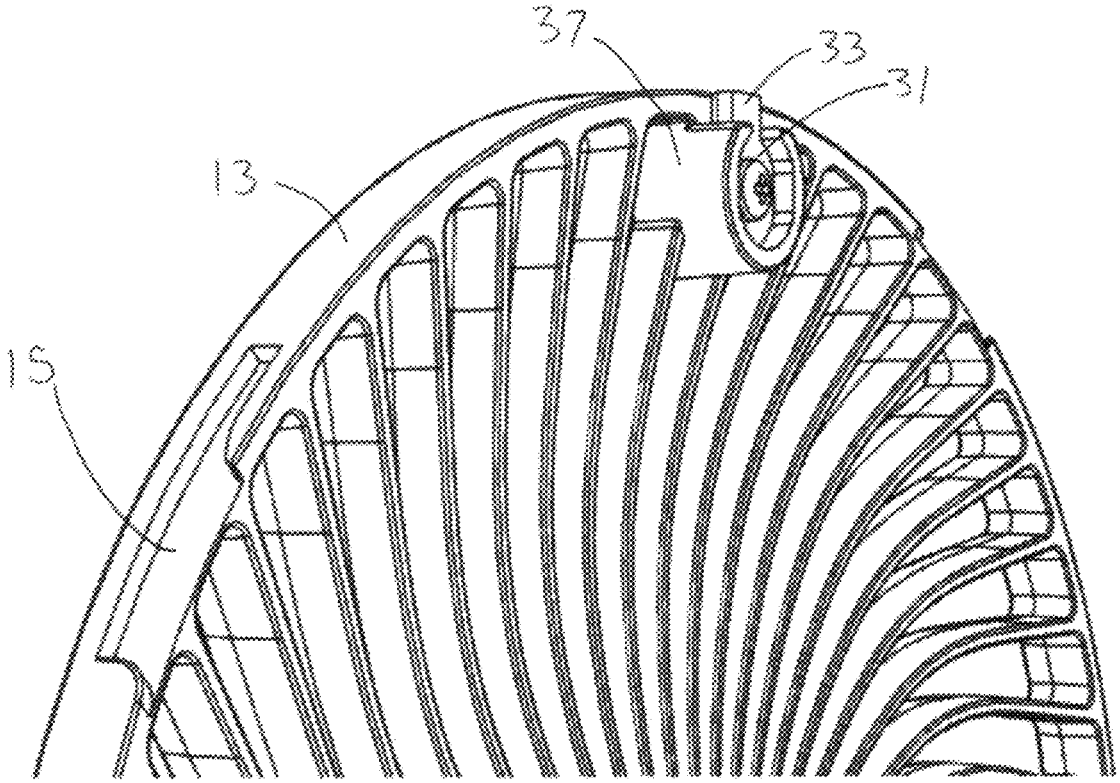
FIG. 6 is a detail perspective view of the rear face of the removable grille, showing the disposition of the latch mechanism and a locking slot on the periphery of the grille.
Figure 7:
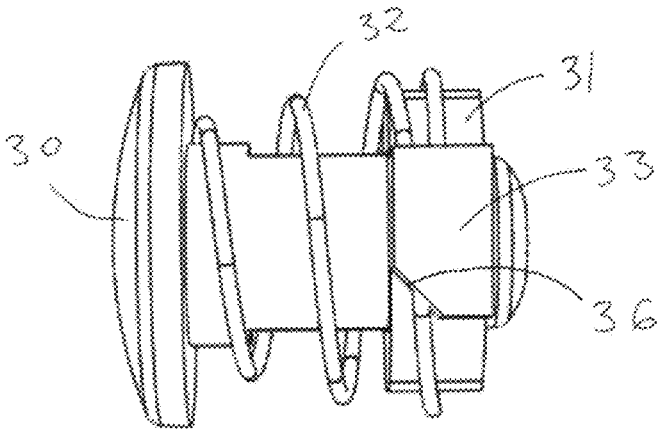
FIG. 7 is view of the grille latch mechanism.
Figure 8:
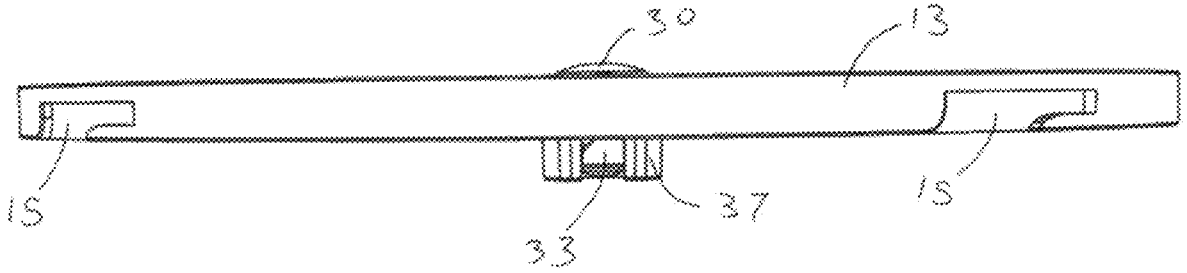
FIG. 8 is an edge view of the removable grille, showing the disposition of the latch mechanism and locking slots on the periphery of the grille.
Figure 9:
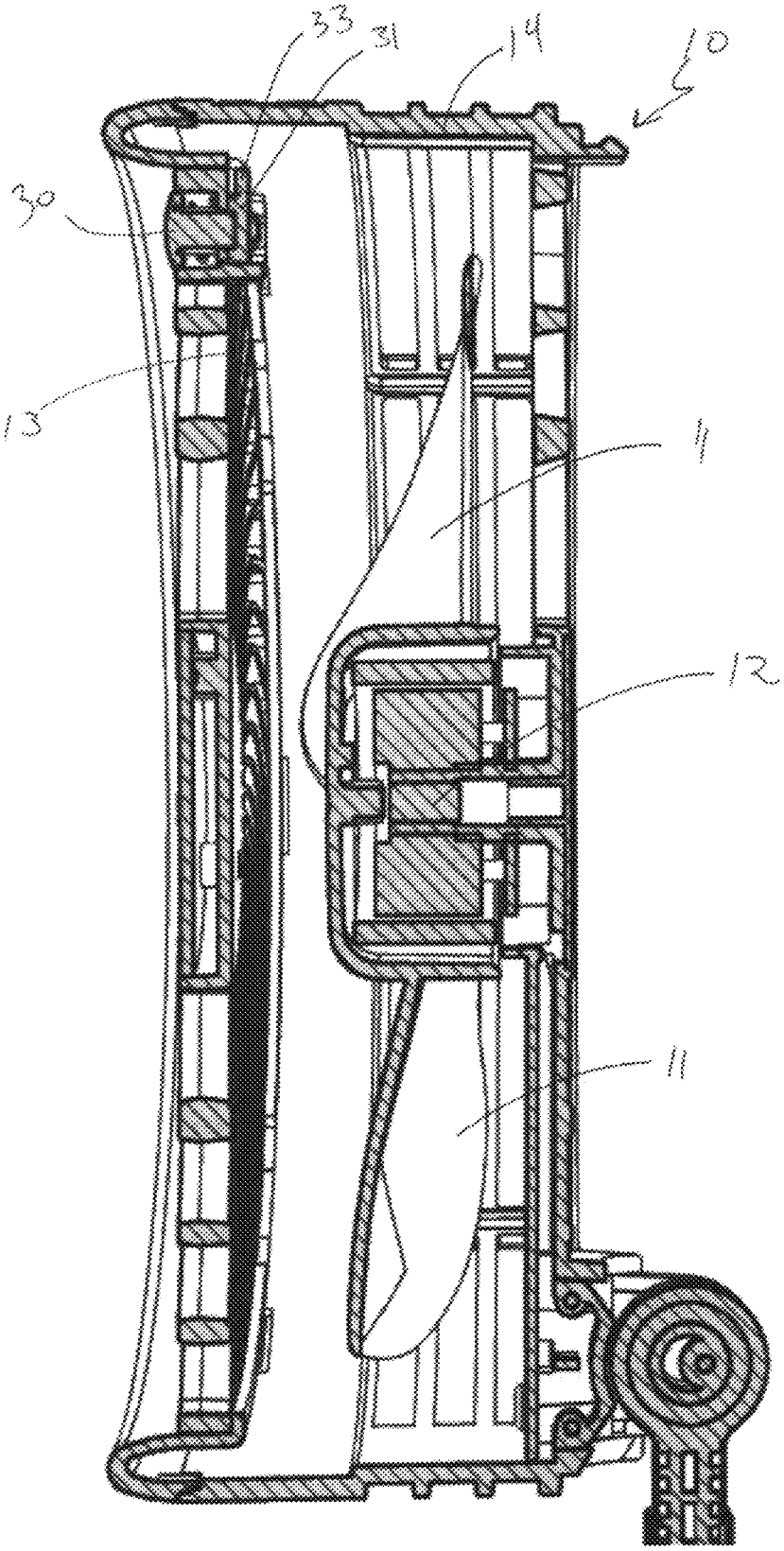
FIG. 9 is a cross section view of the fan portion.
Figure 10:
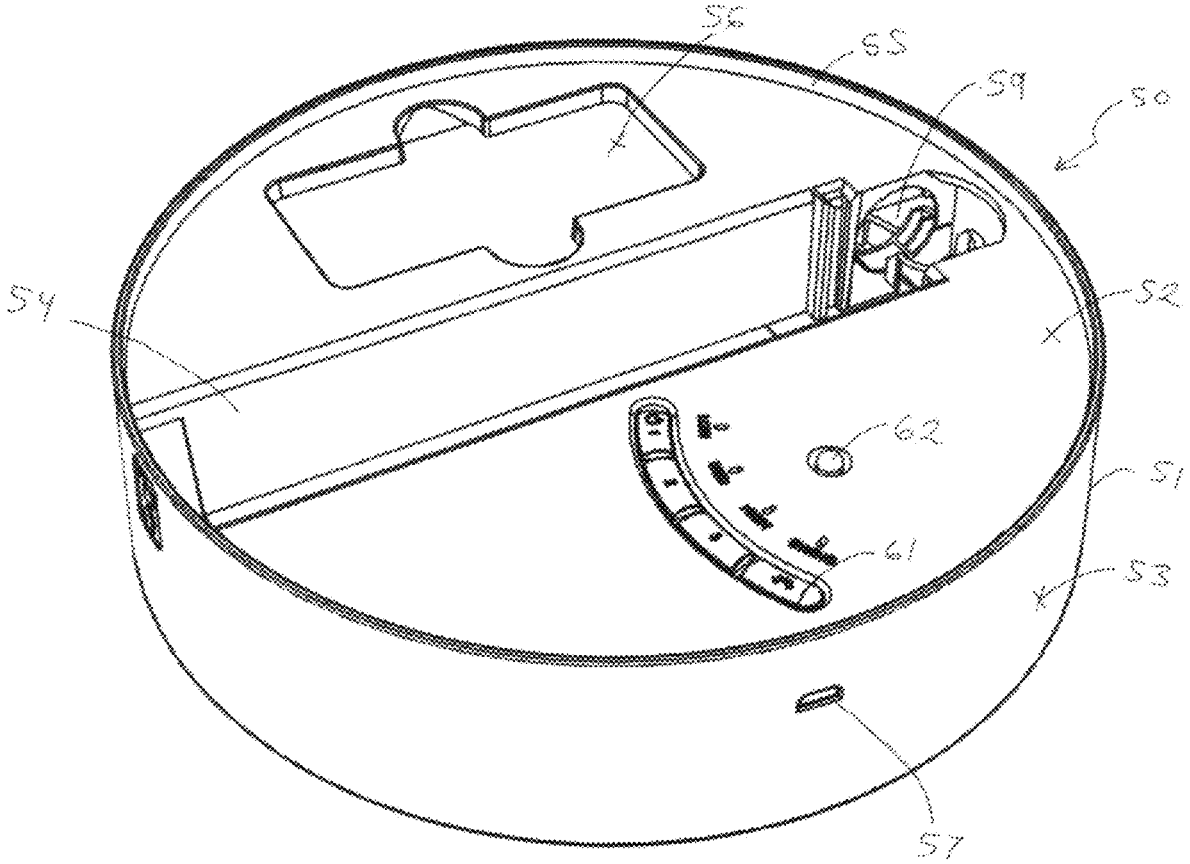
FIG. 10 is a perspective view of the base portion.
Figure 11:
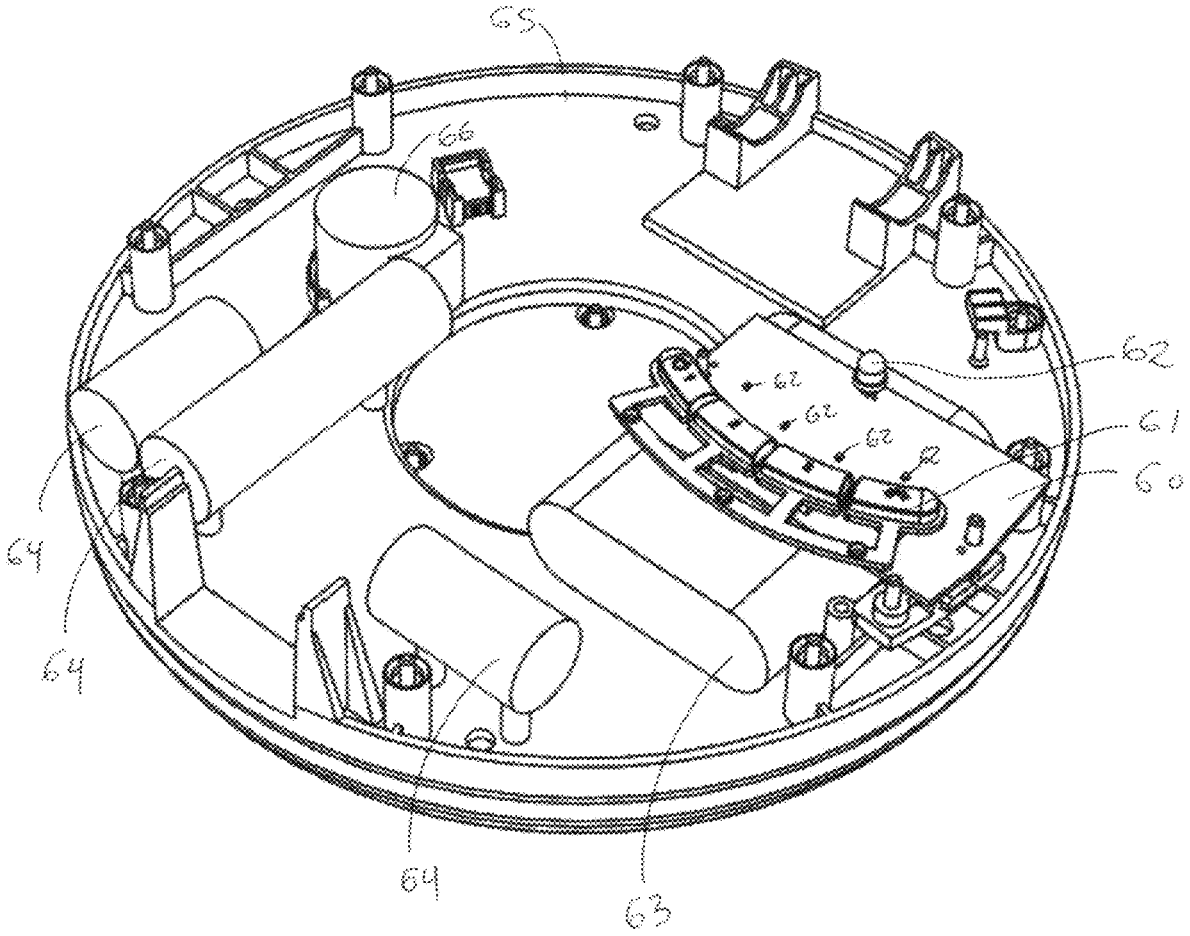
FIG. 11 is a perspective view of the base portion with the housing removed, showing the disposition of internal components of the base portion according to an embodiment.
Figure 12:
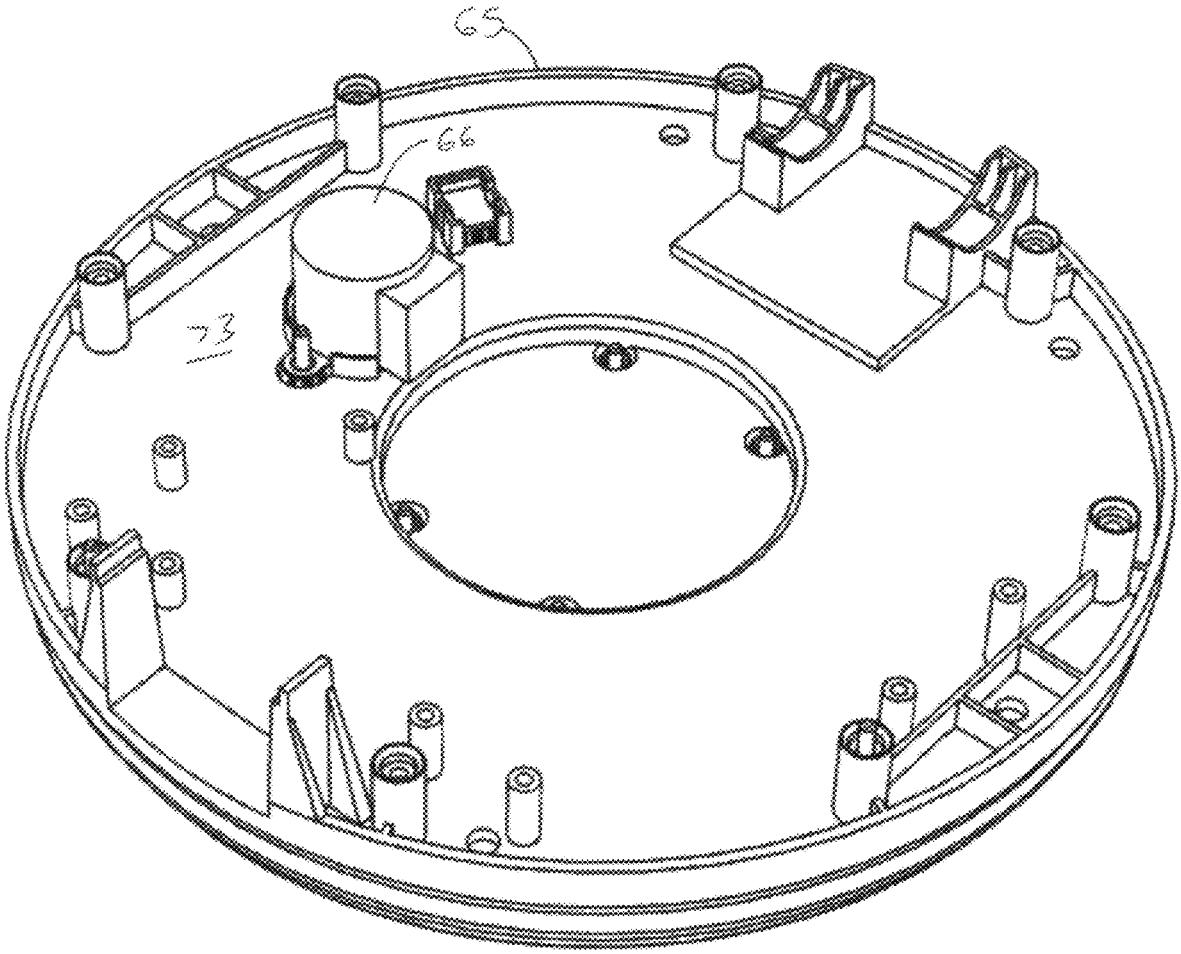
FIG. 12 is a perspective view of the base portion with the housing and most internal components removed, showing the disposition of the internal platform and motor.
Figure 13:
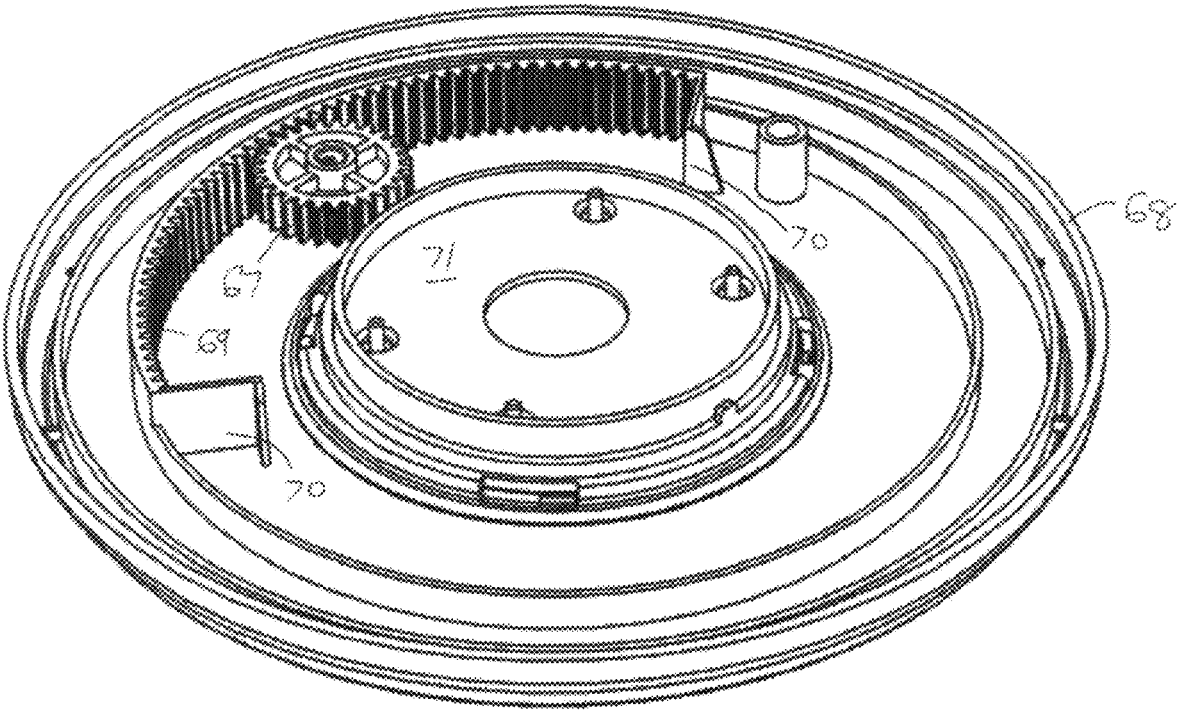
FIG. 13 is a perspective view of the floor of the base portion, showing the disposition of the angular gear and pinion.
Figure 14:
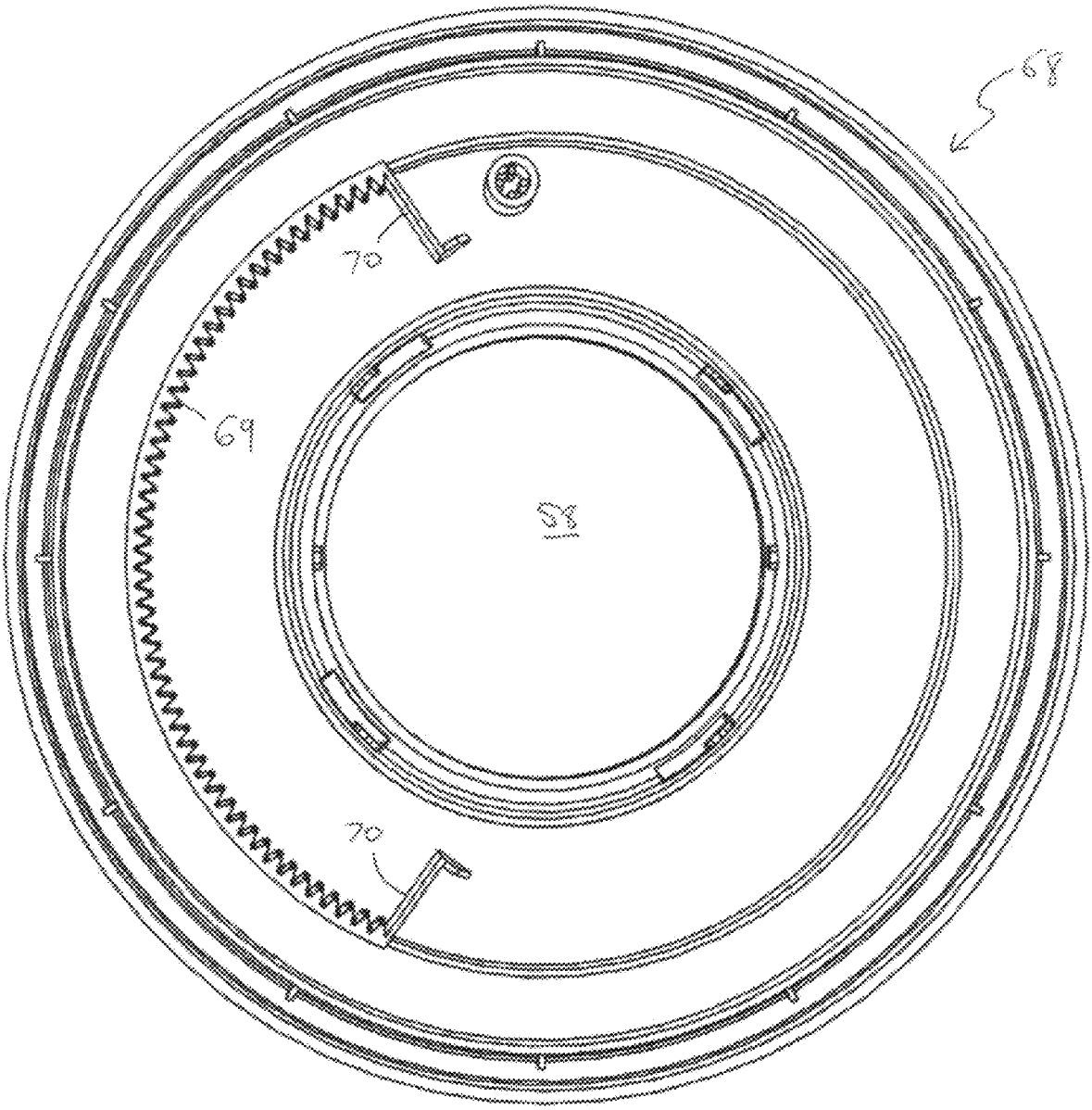
FIG. 14 is a plan view of the floor of the base portion, showing the disposition of the angular gear.
Figure 15:
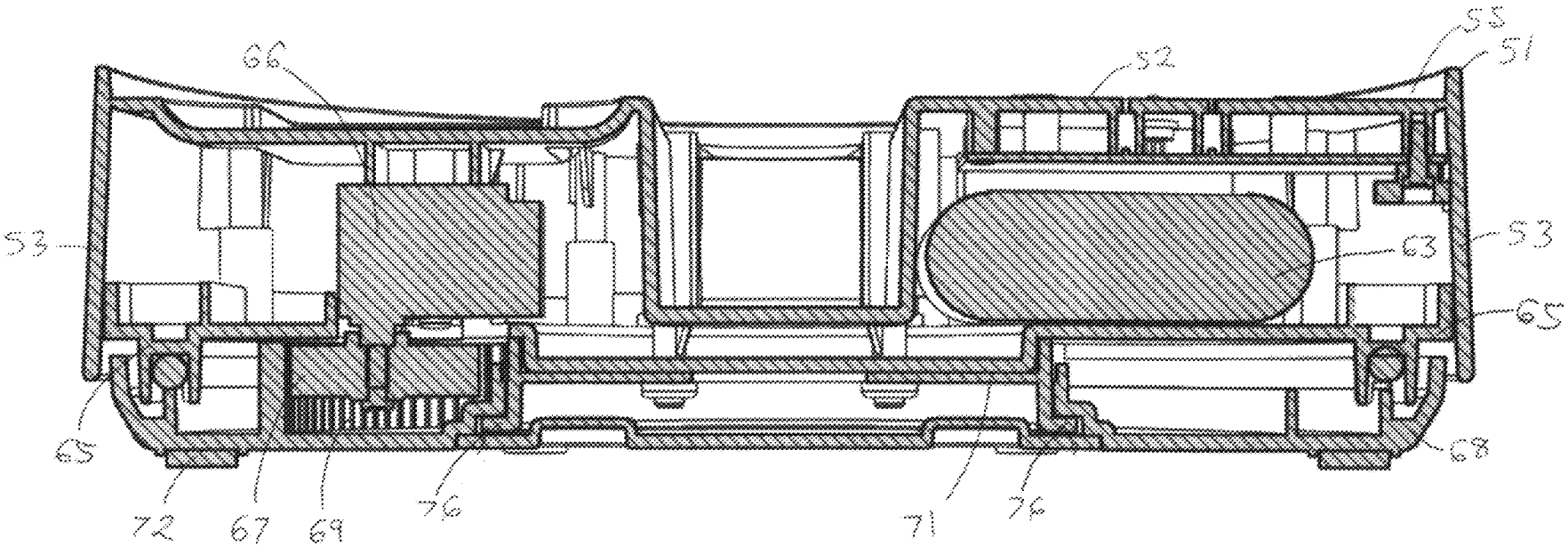
FIG. 15 is a cross-sectional view of the base portion along a plane through the motor, motor spindle and pinion.

In a locked position of the grille 13, as shown for example in FIGS. 3-4 and 9, grille 13 is constrained from rotating to the non-interlocked release position by a manual button-operated latch mechanism disposed at a periphery of grille 13, comprising latch button 30 and latch 31 immovably attached to latch button 30 by, for example, a screw or rivet. Latch button 30 and latch 31 are assembled through a through-going hole disposed near the periphery of grille 13, and a coil spring 32 is disposed with the button 30 to be compressed when button 30 is manually pressed, and to exert a restoring force to restore button 30 and latch 31 to their original position when the pressure is removed. Latch 31 is constrained by latch guide 37, which may be integrally formed with grille 13, to constrain its movement to a perpendicular direction with respect to grille 13. Latch 31 has a tab 33 disposed at the top edge thereof, which in the locked position is trapped in a gap between a pair of tabs 34 on the periphery of the opening of housing 14, preventing grille 13 from rotating unless button 30 is pressed inward. When button 30 is manually pressed inward, latch 31 is also pressed inward so that latch tab 33 is beyond the pair of tabs 34, freeing latch 31 from the gap and permitting rotation of grille 13 to a removable position as previously described. Latch tab 33 has a ramped profile 36 on a corner thereof, counter the direction of the unlocking rotation. In an embodiment, when the user replaces grille 13 in the front-facing opening of housing 14, grille 13 can be manually rotated back into its locked position, during which rotation the encounter of a tab 34 with the profile 36 will cause the button 30 and latch 31 to be depressed without an need for the user to apply pressure to button 30, until latch tab 3 passes the tab 34 and enters the gap between tabs 34, at which point the spring 32 will restore button 30 and latch 31 to their original position, in which tab 33 is trapped in the gap thereby preventing rotation of grille 13 until button 30 is manually depressed again.

According to another aspect of the subject technology, base portion 50 of electric fan 1 comprises base housing 51 which houses the other components of base portion 50. Base portion 50 has upper surface 52 and sidewall 53. In an embodiment, sidewall 53 is cylindrical and is open at the bottom. Floor 68 of base portion 50 is disposed at the bottom of base housing 51, but in an embodiment, floor 68 is not fixedly attached to housing 51, as will be explained hereafter. Channel 54 is formed in upper surface 52 for receiving mast 20 in the mast's retracted and folded configuration, when fan 1 is in the fully or partially folded state. Upper surface 52 has openings for button covers 61 and LEDs 62. At one end of channel 54, openings 59 are formed in housing 51 to receive portions of a base hinge subassembly that hingedly connects mast 20 to base portion 50. In an embodiment, upper surface 52 has a recess 56 to receive and store remote-control transmitter 5. In an embodiment, a lip 55 is formed around the circumference of upper surface 52, and fan housing 14 is formed with an edge that mates neatly with lip 55 when the fan is in the folded and closed position.

Turning now to the internal components of base portion 50, internal platform 65 is disposed within housing 51 and is attached to housing 51 with, for example, screws or rivets. Platform 65 has an opening 74 for base motor 66. Printed circuit board ("PCB") 60 is attached to the upper surface of platform 65 and bears electronic components, circuitry, wires and traces for powering and operating all functions of the fan 1; buttons for changing the operational state of the fan 1 manually; and LEDs 62 driven by the circuitry to indicate the operational state of the fan 1. Button covers 61 are disposed over the buttons and extend through openings in housing 51. In an embodiment, the electronic circuitry includes a remote-control receiver, and the electronic circuitry is configured to receive signals from the remote-control transmitter 5 and change operating modes of the fan in response to the signals. The remote-control transmitter 5 and receiver may employ any suitable technology for transmitting and receiving remote-control signals, such as infrared and radio frequency, as non-limiting examples. The buttons and remote-control transmitter 5 (having its own buttons, not shown) are operable by the user to change the operating modes of the electric fan, exemplary modes being Power On/Off, Swing (i.e. oscillation) On/Off, Fan Speed Low, Fan Speed Medium, Fan Speed High. Weights 64 may be disposed within base portion 50, for example on platform 65, to lower the center of gravity of fan 1 and thereby stabilize it.

Rechargeable battery 63 is disposed within housing 51 and is operably connected to PCB 60 for powering the components of fan 1. Battery 63 is rechargeable through port 57 disposed at sidewall 53. Wires for carrying electrical current extend from PCB 60 to base motor 66 and (through mast 20) to the fan motor in fan portion 10.

In an embodiment, base portion 50 includes an oscillating mechanism to turn the fan 1 in a reciprocating and oscillating pattern, under the control of the electronic circuitry, which can be turned on and off by operation of a button and/or remote-control transmitter 5. In an embodiment, the oscillating mechanism turns the entire fan 1 with respect to floor 68, which remains stationary in contact with the underlying surface. In this embodiment, floor 68 is not immovably fixed (with screws, for example) to the remainder of base portion 50. Rather, floor 68 is rotatably retained to the remainder of base portion 50 by hub 71, which is fixed with screws for example to internal platform 65, and is disposed within a circular opening 58 in floor 68, and rotatably retains floor 68 to the remainder of base portion 50 with a flange 76 of hub 71. In this embodiment, base portion 50 may turn about floor 68 with respect to the remainder of base portion 50.

In an embodiment, the oscillating mechanism comprises an annular gear formed in base portion 50, which in a further embodiment is partial annular gear 69 formed in floor 68 between two stops 70. Pinion 67 is engaged with annular gear 69 and is disposed on the shaft of electric motor 66. Motor 66 is disposed on the upper surface 73 of platform 65 and is fixedly connected to platform 65 or housing 51, or both. Motor 66, or at least the shaft of motor 66, extends through an opening in platform 65, so that pinion 67 is disposed below platform 65 and is in engagement with annular gear 69. When oscillation is selected by operation of the buttons or remote-control transmitter 5, motor 66 is selectively energized from battery 63 under the control of the electronic circuitry to turn pinion 67, which by its engagement with stationary floor 68 and its annular gear 69, turns the remainder of base portion 50 (i.e., excluding floor 68) and thereby turns the mast 20 and fan portion 10 which is connected to base portion 50 via mast 20.

While specific embodiments of the subject technology have been shown and described in detail to illustrate the application of the principles of the subject technology, it will be understood that the invention may be embodied otherwise without departing from such principles. It will also be understood that the present subject technology includes any combination of the features and elements disclosed herein and any combination of equivalent features. The exemplary embodiments shown herein are presented for the purposes of illustration only and are not meant to limit the scope of the subject technology.

What is claimed is:

1. An electric fan comprising:

a fan portion, a base portion, and a telescoping mast having a first end and a second end, the mast hingedly attached to the fan portion at the first end and hingedly attached to the base portion at the second end;

the fan portion comprising:

a fan housing having a front opening;

an electric fan motor disposed within the fan housing;

fan blades attached to a spindle of the fan motor; and a removable grille disposed in the front opening of the fan housing;

the grille and front opening configured and disposed to be engagable in a first position in which the grille is retained in the front opening and rotatable from the first position to a second position in which the grille is released from the front opening;

a latch mechanism configured and disposed to lock the grille in the first position, the latch mechanism comprising a button and a latch configured and disposed to release the lock when the button is depressed;

the electric fan further comprising a battery power source for the electric fan motor, and at least one user-operable button and electronic circuitry for controlling and selectively powering the electric fan motor from the battery power source.

2. The electric fan of claim 1 wherein the base portion comprises a base housing and a base floor having feet disposed to contact an underlying surface, the floor being rotatably retained to a remainder of the base portion.

3. The electric fan of claim 2 wherein the base portion further comprises an oscillating mechanism disposed within the base housing, the oscillating mechanism comprising an electric base motor, the electric fan further comprising at least one user-operable button and electronic circuitry for controlling and selectively powering the electric base motor from the battery power source.

4. The electric fan of claim 3 wherein the oscillating mechanism further comprises a pinion disposed on a spindle of the electric fan motor and the floor comprises an annular gear, the pinion engaged with the annular gear, such that when the electric base motor is powered to turn the pinion, the remainder of the base portion, and the mast, and the fan portion, are turned with respect to the floor.

5. The electric fan of claim 3 wherein the floor is rotatably retained to the remainder of the base portion by a flanged hub attached to the remainder of the base portion.

6. The electric fan of claim 4 wherein the floor is rotatably retained to the remainder of the base portion by a flanged hub attached to the remainder of the base portion.

7. The electric fan of claim 1 wherein the grille comprises one or more slots disposed on a periphery of the grille, the slots configured to engage with corresponding one or more tabs disposed on a periphery of the front opening, configured to retain the grille in the first position, and configured to release the grille when it is rotated into the second position.

* * * * *